US010711429B2

(12) United States Patent
Webb et al.

(10) Patent No.: US 10,711,429 B2
(45) Date of Patent: Jul. 14, 2020

(54) INDICATION SYSTEM FOR A QUICK COUPLER ASSEMBLY

(71) Applicant: Caterpillar SARL, Geneva (CH)

(72) Inventors: Adrian Webb, Cosby (GB); Steven Sudale, Rugeley (GB)

(73) Assignee: Caterpillar SARL, Geneva (CH)

( * ) Notice: Subject to any disclaimer, the term of this patent is extended or adjusted under 35 U.S.C. 154(b) by 293 days.

(21) Appl. No.: 15/736,918

(22) PCT Filed: Jun. 3, 2016

(86) PCT No.: PCT/EP2016/062699
§ 371 (c)(1),
(2) Date: Dec. 15, 2017

(87) PCT Pub. No.: WO2016/206953
PCT Pub. Date: Dec. 29, 2016

(65) Prior Publication Data

US 2018/0171576 A1 Jun. 21, 2018

(30) Foreign Application Priority Data

Jun. 26, 2015 (GB) ..... 1511274.1

(51) Int. Cl.
*E02F 9/26* (2006.01)
*E02F 3/36* (2006.01)

(52) U.S. Cl.
CPC ..... *E02F 3/3663* (2013.01); *E02F 3/3609* (2013.01); *E02F 9/26* (2013.01); *E02F 9/264* (2013.01); *E02F 3/3659* (2013.01)

(58) Field of Classification Search
CPC ..... E02F 3/3663; E02F 3/3609; E02F 9/26; E02F 9/264; E02F 3/3659; E02F 3/365;
(Continued)

(56) References Cited

U.S. PATENT DOCUMENTS 6,431,475 B1 * 8/2002 Williams ..... A01G 25/09 239/740
6,699,001 B2 3/2004 Fatemi
(Continued)

FOREIGN PATENT DOCUMENTS

CN 202867422 U 4/2013
DE 202006018263 U1 3/2007
(Continued)

OTHER PUBLICATIONS

Yoon et al., A study on an energy saving electro-hydraulic excavator, 2009, IEEE, p. 3825-3830 (Year: 2009).*
(Continued)

*Primary Examiner* — McDieunel Marc

(57) ABSTRACT

An indication system associated with a coupler assembly includes a sensing element affixed to the coupler assembly, and an indicator assembly coupled to the sensing element. The sensing element is arranged and positioned proximate to a hydraulic assembly of the coupler assembly. The sensing element is configured to generate a signal indicative of an extension of a piston pin of the hydraulic assembly. The indicator assembly is configured to receive the signal indicative of the extension of the piston pin, and determine if the piston pin is in an extended state based on the received signal.

18 Claims, 4 Drawing Sheets

(58) Field of Classification Search
CPC ..... E02F 3/205; B65G 17/126; B66F 9/12; A01G 25/09; B60D 1/64
See application file for complete search history.

(56) References Cited

U.S. PATENT DOCUMENTS

| | | | | |
|---|---|---|---|---|
| 10,421,325 | B2 * | 9/2019 | Keatley | B60D 1/64 |
| 2011/0313625 | A1 | 12/2011 | Miller et al. | |
| 2012/0158279 | A1 * | 6/2012 | Faivre | E02F 9/26 701/124 |
| 2013/0312601 | A1 | 11/2013 | Subrt | |
| 2014/0331663 | A1 * | 11/2014 | Robl | E02F 3/3663 60/435 |
| 2015/0233084 | A1 * | 8/2015 | Seljestad | E02F 3/3663 414/723 |
| 2015/0233085 | A1 * | 8/2015 | Seljestad | B66F 9/12 414/723 |
| 2015/0267371 | A1 * | 9/2015 | Ciccotelli | E02F 3/205 405/263 |
| 2016/0221761 | A1 * | 8/2016 | Walder | B65G 17/126 |
| 2016/0289914 | A1 * | 10/2016 | Sulzer | E02F 3/365 |

FOREIGN PATENT DOCUMENTS

| | | | |
|---|---|---|---|
| DE | 202013102986 | U1 | 11/2014 |
| GB | 2464988 | A | 5/2010 |
| SE | 1300670 | A1 | 4/2015 |
| WO | 2004/092489 | A1 | 10/2004 |
| WO | 2012/085500 | A2 | 6/2012 |
| WO | 2014/072709 | A1 | 5/2014 |

OTHER PUBLICATIONS

Salcudean et al., Impedance control of a teleoperated mini excavator, 1997, IEEE, p. 19-25 (Year: 1997).*
Tu et al., Design and control of operating manipulator for excavator working device, 2012, IEEE, p. 318-321 (Year: 2012).*
Koo et al., Suppression of vibration caused by quick-stop operation of hydraulic excavators, 2009, IEEE, p. 1333-1337 (Year: 2009).*

* cited by examiner

INDICATION SYSTEM FOR A QUICK COUPLER ASSEMBLY

TECHNICAL FIELD

The present disclosure relates to an indication system, and more particularly to the indication system associated with a coupler assembly of a machine.

BACKGROUND

A linkage assembly of a machine may interchangeably receive different implements or worktools, such as, blades or buckets, based on a type of operation being performed thereby. A hydraulic assembly is generally used for the engagement between the worktool and the linkage assembly. More particularly, piston pins associated with the hydraulic assembly are configured to engage the linkage assembly and the worktool. An extension of the piston pin is important to determine whether the worktool is in positive engagement with the linkage assembly so that the worktool does not fall off the machine during operation. Therefore, an operator of the machine may verify the extended state of the piston pins by visually inspecting the piston pins while seated within an operator cabin. However, visually observing the state of the piston pins may be a cumbersome process, prone to errors, and sometimes unreliable.

SUMMARY OF THE DISCLOSURE

In one aspect of the present disclosure, an indication system associated with a coupler assembly is provided. The indication system includes a sensing element affixed to the coupler assembly. The sensing element is arranged and positioned proximate to a hydraulic assembly of the coupler assembly. The sensing element is configured to generate a signal indicative of an extension of a piston pin of the hydraulic assembly. The indication system also includes an indicator assembly coupled to the sensing element. The indicator assembly is configured to receive the signal indicative of the extension of the piston pin. The indicator assembly is also configured to determine if the piston pin is in an extended state based on the received signal.

In another aspect of the present disclosure, a method for indicating a state of a coupler assembly is provided. The method includes providing a sensing element proximate to a hydraulic assembly of the coupler assembly. The method also includes receiving a signal indicative from the sensing element. The signal is indicative of an extension of a piston pin associated with the hydraulic assembly of the coupler assembly. The method further includes determining if the piston pin is in an extended state based on the received signal.

In yet another aspect of the present disclosure, a coupler assembly associated with a machine is provided. The coupler assembly includes a coupler element configured to couple to a work implement of the machine. The coupler assembly also includes a hydraulic assembly attached to the coupler element. The hydraulic assembly includes a piston pin. The coupler assembly further includes a sensing element affixed to the coupler assembly. The sensing element is arranged and positioned proximate to the hydraulic assembly. The sensing element is configured to generate a signal indicative of an extension of the piston pin of the hydraulic assembly. The coupler assembly includes an indicator assembly coupled to the sensing element. The indicator assembly configured to receive the signal indicative of the extension of the piston pin. The indicator assembly is also configured to determine if the piston pin is in an extended state based on the received signal. The indicator assembly is further configured to trigger a notification based on the determination.

Other features and aspects of this disclosure will be apparent from the following description and the accompanying drawings.

DETAILED DESCRIPTION

Figure 1:
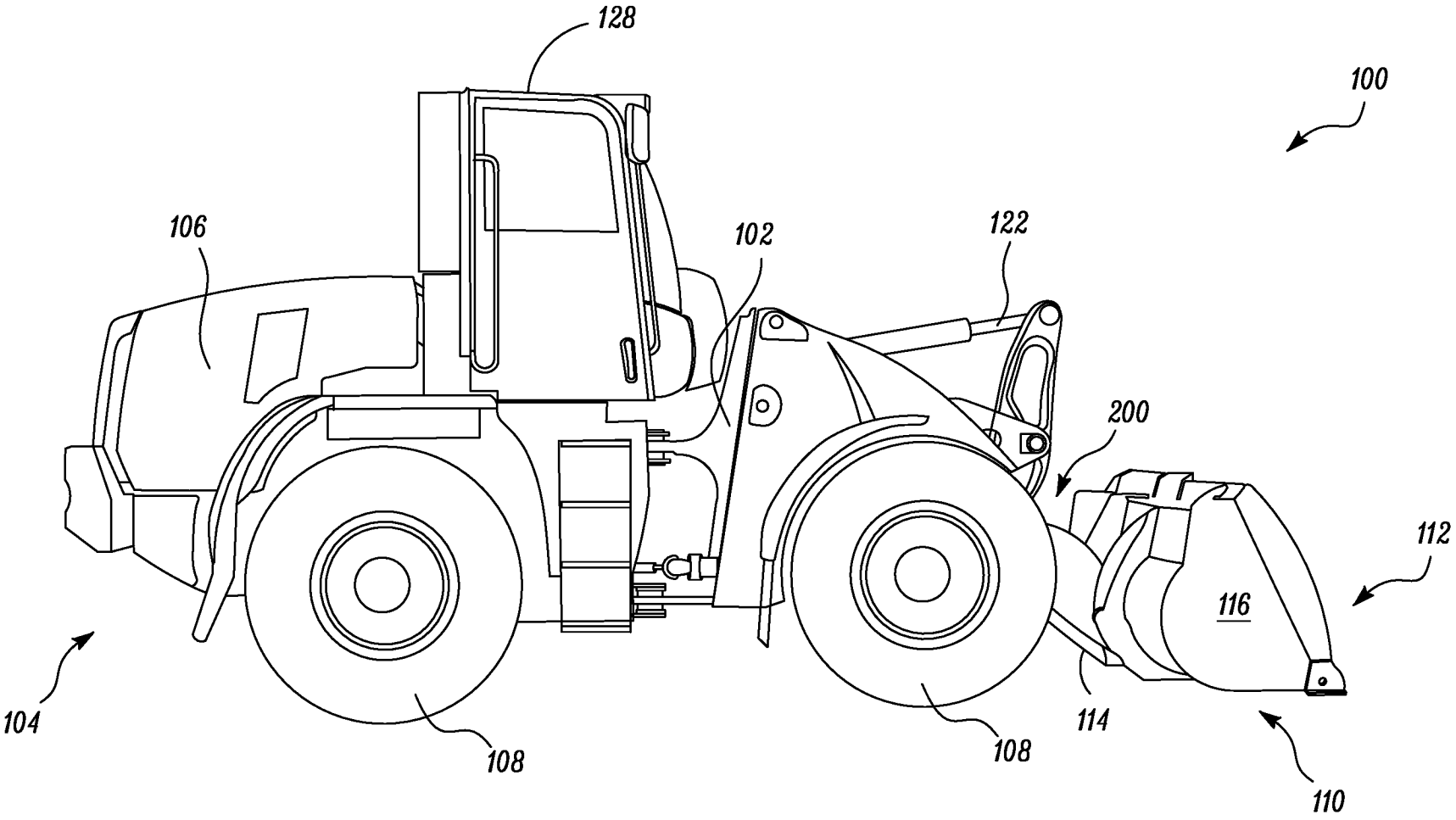
FIG. 1 is a perspective side view of an exemplary machine, according to one embodiment of the present disclosure.

Wherever possible, the same reference numbers will be used throughout the drawings to refer to the same or the like parts. Referring to FIG. 1, an exemplary machine 100 is illustrated. More specifically, the machine 100 is a compact wheel loader. Alternatively, the machine 100 may be any machine including, but not limited to, a skid steer loader, a backhoe loader, an excavator, a shovel, a dozer, a mining truck, an articulated truck, a track type tractor, a forklift, and a crane. The machine 100 may be any machine known in the art associated with industries including, but not limited to, agriculture, transportation, mining, construction, forestry, and material handling.

The machine 100 includes a frame 102. A power source (not shown) is provided at a rear section 104 of the machine 100. More particularly, the power source is provided within an enclosure 106. The power source may be any power source known in the art, such as, an internal combustion engine, an electric motor, power storage device like batteries, and a hybrid engine. The power source is configured to provide power to the machine 100 for operational and mobility requirements. The machine 100 includes a set of ground engaging members 108, herein embodied as wheels. In another example, the ground engaging member 108 may include tracks. The ground engaging members 108 are configured to provide mobility to the machine 100. The machine 100 also includes a drivetrain (not shown) coupled to the power source and the ground engaging members 108. The drivetrain may include a transmission system having one or more gears, shafts, differentials, torque convertor, hydraulic pump or motor, and so on. The drivetrain may be configured to transmit motive power from the power source to the ground engaging members 108.

The machine 100 may include one or more work implements pivotally coupled to the frame 102. In the illustrated embodiment, a linkage assembly 110, hereinafter referred to as a front linkage assembly 110 is provided at a front section 112 of the machine 100. The front linkage assembly 110 includes a linkage member 114. The linkage member 114 is pivotally coupled to the frame 102. A work implement 116, hereinafter referred to as implement 116, is pivotally coupled to the linkage member 114. The implement 116 may be configured to collect, hold, and convey material and/or heavy objects on the ground. Alternatively, the implement 116 may include any one of a bucket, an auger, a blade, a fork, a hammer, a ripper, or any other known work implement. The front linkage assembly 110 is configured to perform tasks such as, earth moving, excavation, digging, demolition, and the like. Further, the front linkage assembly 110 may be controlled electrically, mechanically, hydraulically, pneumatically, or by a combination thereof.

Figure 2:
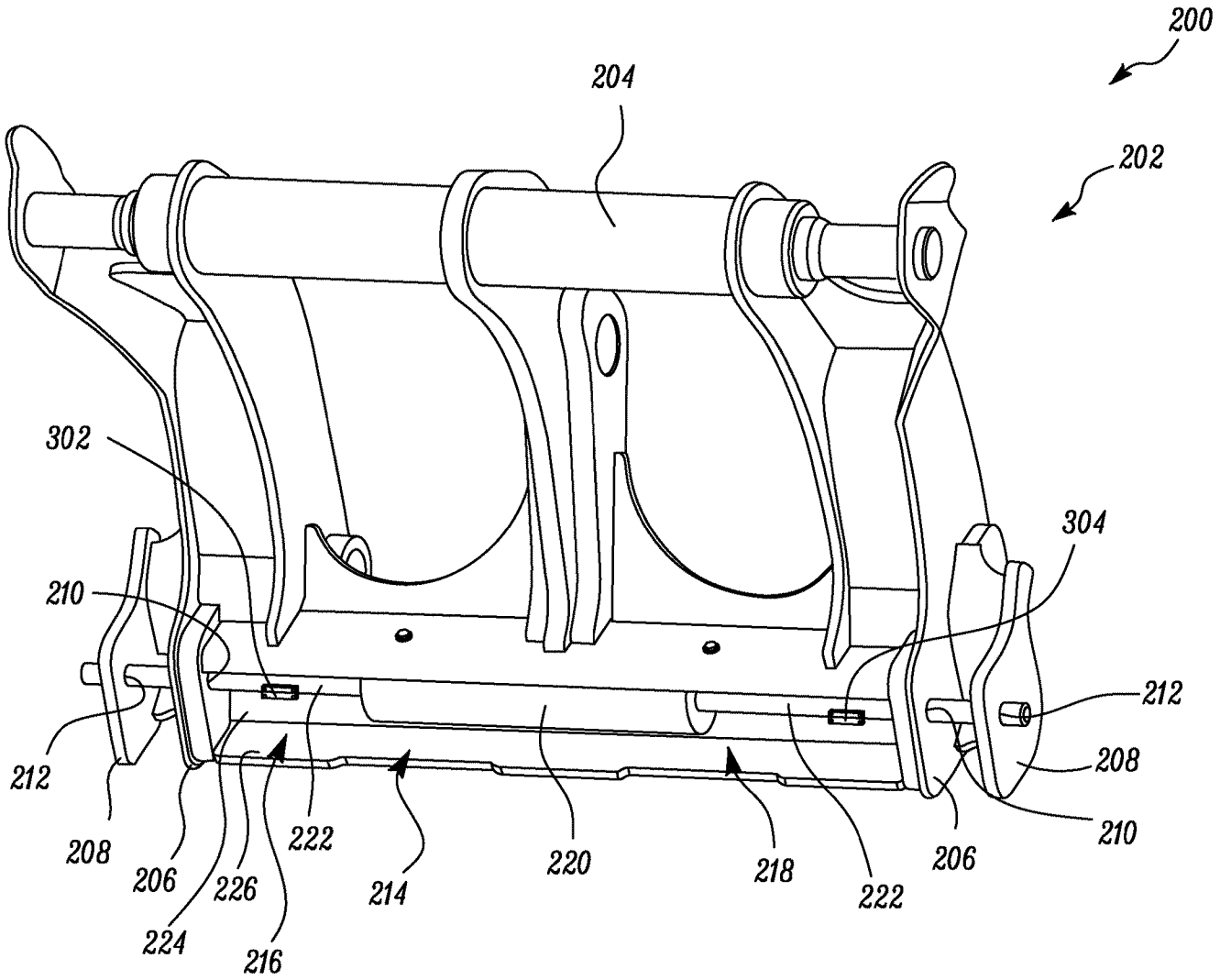
FIG. 2 is a perspective view of a coupler assembly associated with the machine of FIG. 1, according to one embodiment of the present disclosure.

Referring to FIG. 2, the front linkage assembly 110 includes a coupler assembly 200. The coupler assembly 200 may be embodied as a front coupler assembly, a rear coupler assembly, or both of the machine 100. For purpose of simplicity, the coupler assembly 200 will be explained with reference to the front coupler assembly of the machine 100. The coupler assembly 200 is configured to engage the implement 116 with the linkage member 114 (see FIG. 1).

The coupler assembly 200 includes a coupler element 202. The coupler element 202 may include a bar 204 for the implement 116 (see FIG. 1) to hook onto. More particularly, during an engagement of the implement 116 with the coupler element 202, a pair of hooks (not shown) of the implement 116 is coupled with the bar 204 of the coupler element 202. The implement 116 may also include a pair of apertures (not shown) for coupling the implement 116 with the coupler element 202. Referring to FIG. 1, the front linkage assembly 110 includes hydraulic and/or pneumatic cylinders 122 for providing a required spatial movement to the linkage member 114 and the implement 116. In various embodiments, the machine 100 may also include a rear linkage assembly having an associated work implement (not shown) provided at the rear section 104 of the machine 100. The machine 100 also includes an operator cabin 128 provided on the frame 102 of the machine 100. The operator cabin 128 includes an operator interface (not shown). The operator interface may include one or more input devices like pedals, steering, joystick, knobs, levers, switches, display devices, and so on. The input device may assist the operator to operate the machine 100.

Referring to FIG. 2, the coupler element 202 includes a pair of first plates 206 and a pair of second plates 208. Each of the pair of first plates 206 includes an aperture 210. Further, each of the pair of second plates 208 includes an aperture 212, such that the apertures 210, 212 are co-aligned to allow piston pins 222 to pass therethrough.

A hydraulic assembly 214 is associated with the coupler assembly 200. The hydraulic assembly 214 may be actuated when the implement 116 is to be engaged with the coupler element 202. The hydraulic assembly 214 is mounted on the coupler element 202. In one example, wherein the machine 100 is manually operated, the operator of the machine 100 may send an actuation signal to the hydraulic assembly 214 in order to actuate the hydraulic assembly 214. Further, when the machine 100 is embodied as an autonomous machine, the actuation signal may be sent to the hydraulic assembly 214 by an Electronic Control Module (ECM) present on-board the machine 100 or at a location remote to the machine 100.

The hydraulic assembly 214 has a first end 216 and a second end 218. In one example, the hydraulic assembly 214 includes a hydraulic cylinder 220. In one embodiment, the hydraulic cylinder 220 is a double actuating hydraulic cylinder. Alternatively, the hydraulic assembly 214 may include a pair of single actuating cylinders. Further, the hydraulic assembly 214 includes a pair of piston pins 222. The piston pins 222 are configured to reciprocate within the hydraulic cylinder 220. When the hydraulic assembly 214 is actuated and the implement 116 is aligned with the coupler element 202, the piston pin 222 is configured to move outwards. As the piston pins 222 move outwards, the piston pins 222 pass through the aperture 210 of the first plate 206, the aperture of the implement 116, and the aperture 212 of the second plate 208 (see FIG. 2) respectively, in order to couple the implement 116 with the coupler element 202.

An indication system 300 (see FIG. 3) is provided in association with the coupler assembly 200 of the machine 100. The indication system 300 is configured to provide an indication of an extension of the piston pin 222 associated with the hydraulic assembly 214. Further, based on the extension of the piston pin 222, the indication system 300 is also configured to provide an indication of an engagement state of the implement 116 with the coupler assembly 200. The operation of the indication system 300 will now be explained in detail with reference to FIGS. 2 and 3.

Figure 3:
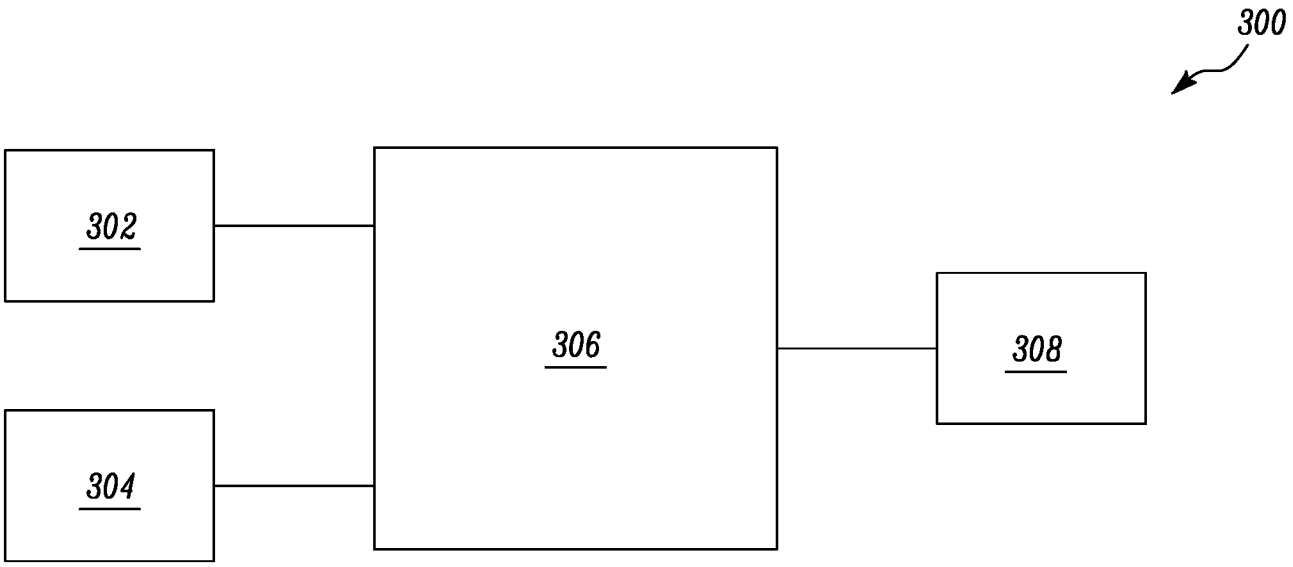
FIG. 3 is a block diagram of an indication system associated with the coupler assembly, according to one embodiment of the present disclosure.

Referring to FIGS. 2 and 3, the indication system 300 includes a sensing element. In one example, the indication system 300 includes a pair of sensing elements 302, 304 provided at the first and second ends 216, 218 of the hydraulic assembly 214 respectively. The sensing element 302, 304 is configured to generate a signal indicative of the extension of each of the piston pins 222 of the hydraulic assembly 214.

The sensing element 302, 304 is affixed to the coupler assembly 200. The sensing element 302, 304 is arranged and positioned proximate to the hydraulic assembly 214 of the coupler assembly 200. As shown in the accompanying figures, the sensing element 302, 304 is positioned on a surface 224 of the coupler assembly 200. Alternatively, the sensing element 302, 304 may also be positioned on another surface 226 of the coupler assembly 200, without any limitations. The sensing element 302, 304 is positioned close to the respective first plates 206. In one embodiment, the sensing element 302, 304 may include a proximity sensor or an inductive sensor. In another embodiment, the sensing element 302, 304 may include a mechanical switch. Alternatively, the sensing element 302, 304 may include any device capable of sensing or detecting presence of objects nearby without any physical contact. The sensing element 302, 304 may be in an activated or a deactivated state. The deactivated state of the sensing element 302, 304 is indicative of an unextended state of the piston pin 222, whereas the activated state of the sensing element 302, 304 is indicative of the extended state of the piston pin 222.

Referring to FIG. 3, the indication system 300 includes an indicator assembly 306. The indicator assembly 306 is communicably coupled with each of the sensing elements 302, 304. The indicator assembly 306 is configured to receive the signal indicative of the extension of the piston pin 222. Based on the received signal, the indicator assembly 306 is configured to determine if the respective piston pin 222 is in the extended state. Further, based on the signal received from the sensing element 302, 304, the indicator assembly 306 is also configured to trigger a notification to the operator of the machine 100 regarding the extension of the respective piston pin 222. Based on the number of the sensing elements in the indication system 300, the indicator assembly 306 may receive corresponding signals associated with each of the piston pins 222 of the hydraulic assembly 214. The communication between the sensing element 302, 304 and the indicator assembly 306 may be wired or wireless, based on the type of application. Further, the indicator assembly 306 may be located on-board the machine 100. In one embodiment, the indicator assembly 306 may be present at a remote location, for example, at a base station.

When the hydraulic assembly 214 is actuated, the piston pin 222 is configured to extend in the outward direction. As the piston pin 222 extends and is positioned within a proximity range of the respective sensing element 302, 304, the sensing element 302, 304 changes state from the deactivated state to the activated state. One of ordinary in the skill in the art will appreciate that the working of the sensing element 302, 304 described herein is exemplary and does not limit the scope of the present disclosure. The operation of the sensing element 302, 304 may vary based on the type of the electronic sensor used in association with the coupler assembly 200. A continual movement of the piston pin 222 causes the piston pin 222 to further pass through the aperture 210 of the first plate 206, the aperture of the implement 116, and the aperture 212 of the second plate 208 (see FIG. 2) respectively for engagement of the implement 116 with the coupler assembly 200.

Based on the change in the state of the sensing element 302, 304 or on the activation of the sensing element 302, 304, the indicator assembly 306 triggers the notification in order to inform a person, such as the operator, of the extension of the piston pin 222. Further, the indicator assembly 306 triggers the notification in order to inform the person of the engagement state of the piston pins 222 with the implement 116. In one situation, the operator may operate the linkage assembly 110 to test and confirm whether the implement 116 has properly engaged with the coupler assembly 200. In one example, the testing may include actuation of the front linkage assembly 114 of the machine 100 to move in a predetermined direction. Based on the receipt of the notification and the testing, the engagement state of the implement 116 with the coupler element 202 is determined. The determination of the engagement state of the hydraulic assembly 214 is indicative that both the piston pins 222 associated with the hydraulic assembly 214 are in the extended state. In one embodiment, if any one of the two piston pins 222 is not determined to be in the extended state, the indicator assembly 306 may be determine an improper engagement of the piston pins 222 and the implement 116.

The notification may be provided via an output module 308 (see FIG. 3). The output module 308 is communicably coupled to the indicator assembly 306 in a wired or wireless manner. The output module 308 is configured to provide the indication to the operator of the extended state of the piston pin 222. The output module 308 may be mounted at a location such that the output module 308 may be viewable to the operator. For example, the output module 308 may be present in the operator cabin 128 of the machine 100, and may be viewable on the operator interface. Alternatively, the output module 308 may form a part of a dashboard of the machine 100, and may be provided adjacent to a speedometer or a fuel level indicator.

The output module 308 may embody a visual output or an audio output. In one example, in case of an audible output, an alarm generated by the output module 308 may notify the operator of a status of the system. In another example, wherein the output module 308 is embodied as a visual output, the output module 308 may include any one of a digital display device, a Liquid Crystal Display (LCD) device, a Light-Emitting Diode (LED) device, a cathode ray tube (CRT) monitor, a touchscreen device, or any other display device known in the art. In one example, the output module 308 may notify the operator regarding the extension of the piston pin 222 through a text message.

Alternatively, the output module 308 may include an indicator light. An LED light or an LCD light may be used to notify the person of the extension of the piston pin 222. For example, if the sensing element 302, 304 is in the activated state, the indicator light may glow of a green color, indicating to the operator that the piston pin 222 is in the extended state. In another example, if the sensing element 302, 304 is in the deactivated state, the indicator light may glow of a red color indicating to the operator that that the piston pin 222 is not in the extended state. In a situation wherein the output module 308 is embodied as the audio output, an audio clip may be heard; thereby notifying the operator regarding the extended state of the piston pin 222. It should be noted that the output module 308 may include any other means other than those listed above.

In one embodiment, the indication system 300 may include detection of an electronic fault associated with the sensing element 302, 304. Due to change in configuration of the sensing element 302, 304 from open to close state during operation thereof, the indicator assembly 306, the ECM of the machine 100, or both may be capable of detecting failure of the sensing element 302, 304, in case a fault occurred. Accordingly, on detection of the fault associated with the sensing element 302, 304, the operator may be notified by an audio or visual alert so that corrective action may be taken. In one example, an error code may be displayed for fault fixing. In another example, an alarm may be sounded. In yet another example, flashing of icons visible to the operator may be triggered.

The indicator assembly 306 may embody a single microprocessor or multiple microprocessors for receiving signals from components of the indication system 300. Numerous commercially available microprocessors may be configured to perform the functions of the indicator assembly 306. A person of ordinary skill in the art will appreciate that the indicator assembly 306 may additionally include other components and may also perform other functions not described herein.

INDUSTRIAL APPLICABILITY

The indication system 300 of the present disclosure includes a pair of sensing elements 302, 304 that are configured to generate signals indicative of the extension of the piston pins 222. These signals are received by the indicator assembly 306 that is configured to determine if the piston pins 222 of the hydraulic assembly 214 are in the extended state. The indication system 300 gives a reliable and accurate indication of the extended state of the piston pin 222. Further, the indication system 300 includes fewer parts and is cost effective. The indication system 300 gives a real time in-cab feedback to the operator pertaining to the extension of the piston pin 222.

Figure 4:
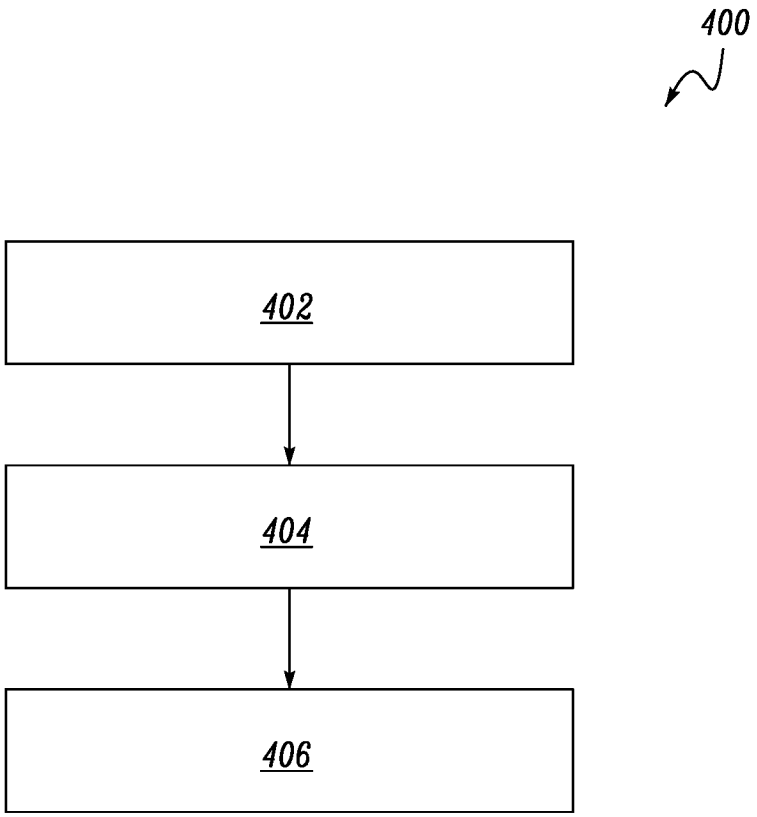
FIG. 4 is a flowchart for a method of indicating a state of the coupler assembly, according to one embodiment of the present disclosure.

FIG. 4 is a flowchart for a method 400 of indicating the extension of the piston pin 222. At step 402, the sensing element 302, 304 is provided proximate to the hydraulic assembly 214 of the coupler assembly 200. At step 404, the signal indicative of the extension of the piston pin 222 associated with the hydraulic assembly 214 of the coupler assembly 200 is received by the indicator assembly 306. At step 406, based on the receipt of the signals from the sensing element 302, 304, the extended state of the piston pin 222 is determined by the indicator assembly 306. Further, based on the determination of the extended state of the piston pin 222, the indicator assembly 306 determines the engagement state of the implement 116 with the coupler assembly 200.

The indicator assembly 306 triggers the notification of the extension of the piston pin 222. The notification is sent to the output module 308 that indicates to the operator regarding the extension of the piston pin 222. Further, based on the determination of the extended state of the piston pin 222, the operator of the machine 100 may test the engagement of the implement 116 with the coupler assembly 200. The testing may include the actuation of the front linkage assembly 110 of the machine 100 to move in the predetermined direction. Based on the receipt of the notification of the extended state of the piston pin 222 and the testing, the engagement state of the implement 116 and the coupler assembly 200 is determined.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An indication system for a coupler assembly, the indication system comprising:

a coupler element including a first plate defining a first aperture therethrough;

a hydraulic assembly mounted on the coupler element, the hydraulic assembly including a hydraulic cylinder and a first piston pin disposed at least partly within the hydraulic cylinder, the hydraulic cylinder being configured to translate the first piston pin along a longitudinal axis of the first piston pin, the longitudinal axis of the first piston pin being coaxial with the first aperture of the first plate, an extended position of the first piston pin relative to the hydraulic cylinder locating the first piston pin within the first aperture, and a retracted position of the first piston pin relative to the hydraulic cylinder locating the first piston pin away from and out of engagement with the first aperture;

a sensing element affixed to the coupler element, the sensing element being located proximate to the first piston pin and located between the hydraulic cylinder and the first plate along the longitudinal axis, the sensing element being configured to generate a first signal in response to the first piston pin being located in the extended position, and generate a second signal in response to the first piston pin being located in the retracted position, the first signal being different from the second signal; and an indicator assembly coupled to the sensing element, the indicator assembly being configured to:

receive the first signal and the second signal; and determine whether the first piston pin is in the extended position based on at least one of the first signal and the second signal.

2. The indication system of claim 1, wherein the indicator assembly is further configured to trigger a notification based on the determination.

3. The indication system of claim 2, further comprising an output module coupled to the indicator assembly.

4. The indication system of claim 1, wherein the indicator assembly is further configured to determine an engagement state of the coupler assembly based, at least in part, on a determination that the first piston pin is located in the extended position.

5. The indication system of claim 1, wherein the sensing element includes a proximity sensor.

6. A method for indicating a state of a coupler assembly, the coupler assembly including a coupler element including a first plate defining a first aperture therethrough;

a hydraulic assembly mounted on the coupler element, the hydraulic assembly including a hydraulic cylinder and a first piston pin disposed at least partly within the hydraulic cylinder, the hydraulic cylinder being configured to translate the first piston pin along a longitudinal axis of the first piston pin, the longitudinal axis of the first piston pin being coaxial with the first aperture of the first plate, an extended position of the first piston pin relative to the hydraulic cylinder locating the first piston pin within the first aperture, and a retracted position of the first piston pin relative to the hydraulic cylinder locating the first piston pin away from and out of engagement with the first aperture; and a sensing element affixed to the coupler element, the sensing element being located proximate to the first piston pin and located between the hydraulic cylinder and the first plate along the longitudinal axis, the sensing element being configured to generate a first signal in response to the first piston pin being located in the extended position, and generate a second signal in response to the first piston pin being located in the retracted position, the first signal being different from the second signal, the method comprising: receiving, within an indicator assembly, the first signal and the second signal; and determining, via the indicator assembly, whether the first piston pin is in the extended position based on at least one of the first signal and the second signal.

7. The method of claim 6, further comprising triggering a notification based on the determination.

8. The method of claim 6, further comprising determining an engagement state of the coupler assembly based, at least in part, on a determination that the first piston pin is located in the extended position.

9. The method of claim 8, further comprising testing an engagement of the coupler assembly with a work implement, based on the determination of the engagement state of the coupler assembly.

10. The method of claim 9, wherein the testing comprises actuating a linkage assembly of a machine to move in a predetermined direction.

11. A coupler assembly for a machine, the coupler assembly comprising:

a coupler element configured to couple to a work implement of the machine, the coupler element including a first plate defining a first aperture therethrough;

a hydraulic assembly attached to the coupler element, the hydraulic assembly including a hydraulic cylinder and a first piston pin disposed at least partly within the hydraulic cylinder, the hydraulic cylinder being configured to translate the first piston pin along a longitudinal axis of the first piston pin, the longitudinal axis of the first piston pin being coaxial with the first aperture of the first plate, an extended position of the first piston pin relative to the hydraulic cylinder locating the first piston pin within the first aperture, and a retracted position of the first piston pin relative to the hydraulic cylinder locating the first piston pin away from and out of engagement with the first aperture;

a sensing element affixed to the coupler element, the sensing element being located proximate to the first piston pin and located between the hydraulic cylinder and the first plate along the longitudinal axis, the sensing element being configured to generate a first signal in response to the first piston pin being located in the extended position, and generate a second signal in response to the first piston pin being located in the retracted position, the first signal being different from the second signal; and an indicator assembly coupled to the sensing element, the indicator assembly being configured to:

receive the first signal and the second signal;

determine if the first piston pin is in the extended position based on at least one of the first signal and the second signal; and trigger a notification based on the determination.

12. The coupler assembly of claim 11, wherein the sensing element includes a proximity sensor.

13. The coupler assembly of claim 11, further comprising an output module coupled to the indicator assembly.

14. The coupler assembly of claim 11, wherein the indicator assembly is further configured to determine an engagement state of the coupler assembly based, at least in part, on a determination that the first piston pin is located in the extended position.

15. The indication system of claim 1, wherein the coupler element further includes a second plate defining a second aperture therethrough, the longitudinal axis of the first piston pin being coaxial with the second aperture of the second plate, and wherein the extended position of the first piston pin relative to the hydraulic cylinder locates the first piston pin within both the first aperture and the second aperture.

16. The indication system of claim 1, wherein the coupler element further includes a second plate defining a second aperture therethrough, wherein the hydraulic assembly further includes a second piston pin disposed at least partly within the hydraulic cylinder, the hydraulic cylinder being disposed between the first piston pin and the second piston pin along the longitudinal axis of the first piston pin, a longitudinal axis of the second piston pin being coaxial with the second aperture of the second plate, an extended position of the second piston pin relative to the hydraulic cylinder locating the second piston pin within the second aperture, and a retracted position of the second piston pin relative to the hydraulic cylinder locating the second piston pin away from and out of engagement with the second aperture, wherein the sensing element is a first sensing element, and the indication system further comprises a second sensing element affixed to the coupler element, the second sensing element being located proximate to the second piston pin and located between the hydraulic cylinder and the second plate along the longitudinal axis of the second piston pin, the second sensing element being configured to generate a third signal in response to the second piston pin being located in the extended position, and generate a fourth signal in response to the second piston pin being located in the retracted position, the third signal being different from the fourth signal.

17. The indication system of claim 16, wherein the indicator assembly is further coupled to the second sensing element, and the indicator assembly is further configured to:

receive the third signal and the fourth signal; and determine if the second piston pin is in the extended position based on at least one of the third signal and the fourth signal.

18. The indication system of claim 16, wherein the coupler element further includes a third plate defining a third aperture therethrough, the longitudinal axis of the first piston pin being coaxial with the third aperture of the third plate, and wherein the extended position of the first piston pin relative to the hydraulic cylinder locates the first piston pin within both the first aperture and the third aperture.

* * * * *